US011918886B2

(12) United States Patent
Collins et al.

(10) Patent No.: US 11,918,886 B2
(45) Date of Patent: Mar. 5, 2024

(54) COIL PROTECTION ASSEMBLY

(71) Applicant: GRIT INC., Loretto (CA)

(72) Inventors: Gregory James Collins, Loretto (CA); Steven Roncadin, Maple (CA); Erin Dawn Dobo, Toronto (CA)

(73) Assignee: Grit Inc. (CA)

( * ) Notice: Subject to any disclaimer, the term of this patent is extended or adjusted under 35 U.S.C. 154(b) by 993 days.

(21) Appl. No.: 16/754,005

(22) PCT Filed: Oct. 4, 2018

(86) PCT No.: PCT/IB2018/001247
§ 371 (c)(1),
(2) Date: Apr. 6, 2020

(87) PCT Pub. No.: WO2019/069136
PCT Pub. Date: Apr. 11, 2019

(65) Prior Publication Data

US 2023/0271079 A1 Aug. 31, 2023

Related U.S. Application Data

(60) Provisional application No. 62/568,830, filed on Oct. 6, 2017.

(51) Int. Cl.
*A41D 13/08* (2006.01)
*A63B 71/12* (2006.01)
(Continued)

(52) U.S. Cl.
CPC ..... *A63B 71/143* (2013.01); *A41D 13/088* (2013.01); *A63B 71/12* (2013.01);
(Continued)

(58) Field of Classification Search
CPC . A41D 13/088; A41D 19/1594; A63B 71/143
See application file for complete search history.

(56) References Cited

U.S. PATENT DOCUMENTS 3,942,525 A * 3/1976 Dragan ..... A61F 5/0118 473/62
4,287,609 A * 9/1981 Amadeo ..... A41D 13/081 2/16

(Continued)

FOREIGN PATENT DOCUMENTS

CA 2137027 A1 5/1996

OTHER PUBLICATIONS

Chinese Office Action dated Jul. 21, 2021, for Application No. 201880065214.3, 10 pages.

(Continued)

*Primary Examiner* — Richale L Quinn
(74) *Attorney, Agent, or Firm* — Frost Brown Todd LLP

(57) ABSTRACT

The present disclosure includes a coil protection assembly configured to be incorporated into a piece of sports equipment such as a glove, shin guard, or shoulder pad. The coil protection assembly may include a coil element spiraled to form a plurality of loops. The coil protection assembly may also have a foam layer disposed on the interior surface of the coil element. An outer layer may enclose or encase the coil element and the foam layer with the loops free to move with respect to one another, A strip of liner material may be secured to the outer layer to connect the loop together. The liner material may be an elastic material to allow the loops to move away from each other, yet still retract back to a default position.

20 Claims, 12 Drawing Sheets

(51) Int. Cl.
*A63B 71/14* (2006.01)
*A41D 19/015* (2006.01)

(52) U.S. Cl.
CPC ..... *A41D 19/01594* (2013.01); *A63B 2071/1258* (2013.01); *A63B 2071/1275* (2013.01); *A63B 2209/00* (2013.01); *A63B 2209/10* (2013.01)

(56) References Cited

U.S. PATENT DOCUMENTS 4,632,105 A * 12/1986 Barlow ..... A61F 13/108 602/64
4,829,604 A 5/1989 Allen et al.
4,843,651 A * 7/1989 Gramza ..... A63B 71/148 2/163
5,313,667 A * 5/1994 Levine ..... A41D 13/088 2/160
5,873,130 A * 2/1999 Lafferty ..... A41D 13/088 473/59
5,978,964 A 11/1999 Gaston
6,093,165 A * 7/2000 Estwanik ..... A63B 71/145 2/161.7
6,691,315 B1 * 2/2004 Clarke ..... A63B 71/145 2/18
6,706,867 B1 * 3/2004 Lorenz ..... C12Q 1/6883 435/6.16
7,383,588 B2 * 6/2008 Victor ..... A41D 20/00 2/22
7,854,714 B1 * 12/2010 Weber ..... A61F 5/0118 128/880
8,312,563 B1 * 11/2012 Burns ..... A41D 19/01588 2/161.1
8,641,650 B2 * 2/2014 Spitzer ..... A61F 5/0118 602/5
8,657,771 B2 * 2/2014 Weaver, II ..... A61F 5/0118 602/22
D715,004 S * 10/2014 Furukawa ..... D29/113
9,387,109 B2 * 7/2016 Keoshian ..... A61F 5/0118
D827,478 S * 9/2018 Samardzija ..... D11/3
10,080,392 B2 * 9/2018 McCully ..... A63B 71/145
D955,057 S * 6/2022 Collins ..... D29/116.3
D990,690 S * 6/2023 Stearns ..... D24/190
2004/0244088 A1 * 12/2004 Greenhalgh ..... A41D 13/088 2/16
2005/0209545 A1 * 9/2005 Farrow ..... A61H 1/008 602/75
2008/0104737 A1 * 5/2008 Shepherd ..... A61F 5/0118 2/161.1
2008/0120755 A1 * 5/2008 Ingram ..... A63B 21/4001 2/20
2015/0052655 A1 * 2/2015 McCully ..... A41D 13/084 2/16
2020/0338432 A1 * 10/2020 Valencia ..... A63B 71/14

OTHER PUBLICATIONS

International Search Report and Written Opinion dated Feb. 21, 2019 for International Application No. PCT/IB2018/001247, 8 pages.

* cited by examiner

COIL PROTECTION ASSEMBLY

BACKGROUND

In some instances, it may be desirable to protect a body part of an individual from injury or striking. For example, in many sports it may be desirable to protect a participant's wrists, shins, ankles, and/or shoulders from impact with another individual, stick, bat, ball, and/or puck. However, reinforcing these areas often severely limits mobility. For example, reinforcing the wrist area of a hockey glove often limits mobility of the hockey player's wrist. Thus, as many sports require dexterity in the wrists, ankles, and/or shoulders, protecting the sports participant's body while also providing for mobility is a problem in the field.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1A:
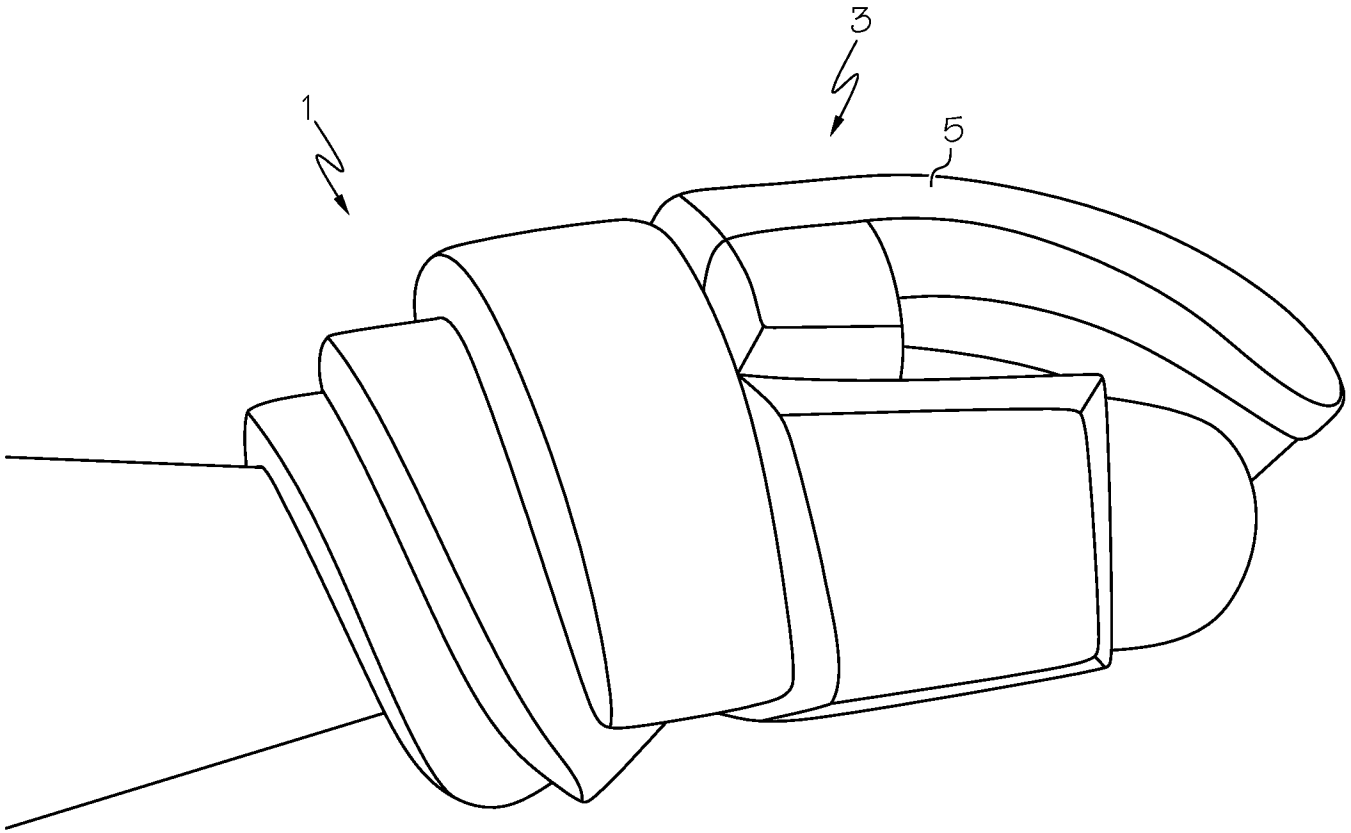
FIG. 1A depicts a perspective view of an exemplary hockey glove disposed on a user's hand and incorporating exemplary coil protection assembly, with the coil protection assembly depicted in a generally neutral position.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

It will be appreciated that any one or more of the teachings, expressions, versions, examples, etc. described herein may be combined with any one or more of the other teachings, expressions, versions, examples, etc. that are described herein. The following-described teachings, expressions, versions, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

I. COIL PROTECTION ASSEMBLY

Figure 1B:
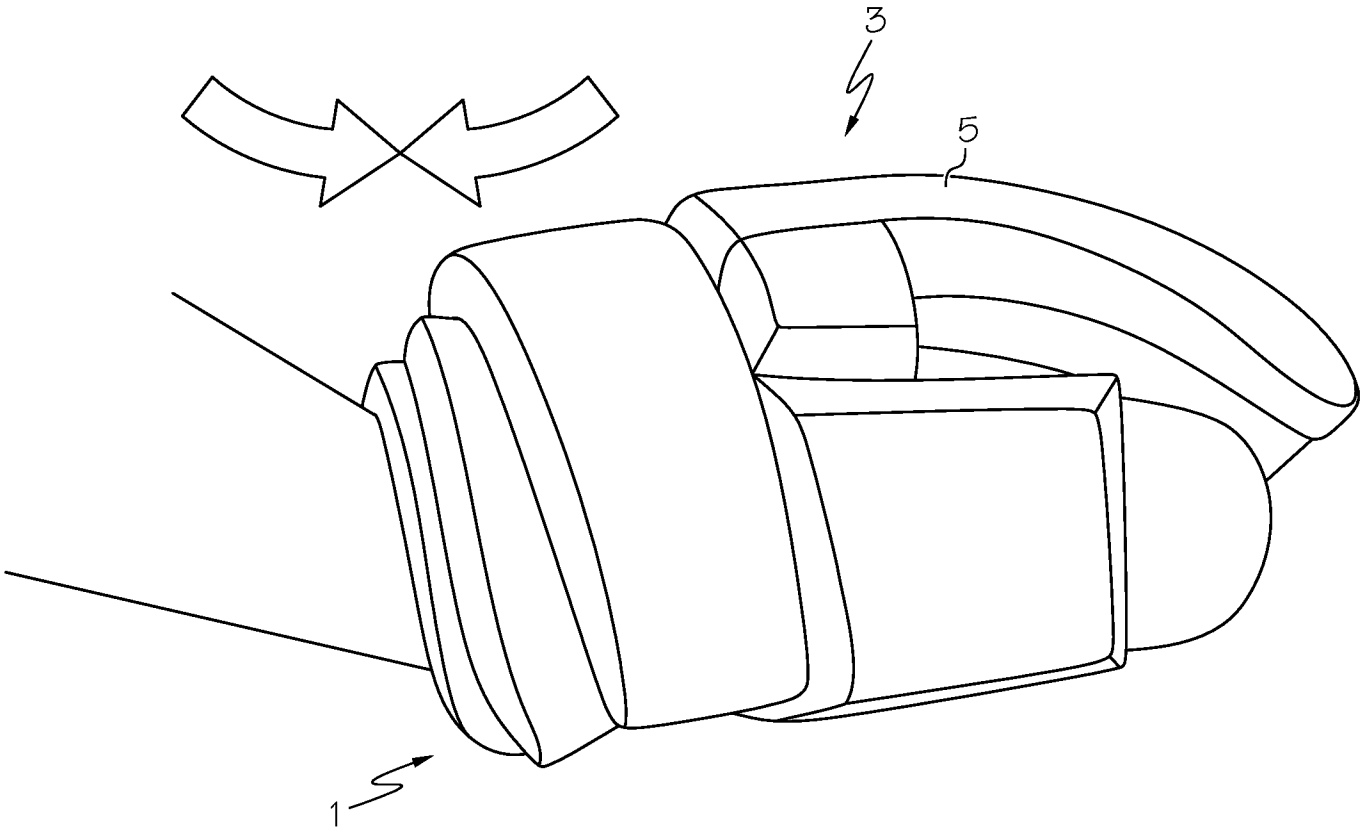
FIG. 1B depicts the hockey glove of FIG. 1A with the coil protection assembly, flexed in a first direction.
Figure 1C:
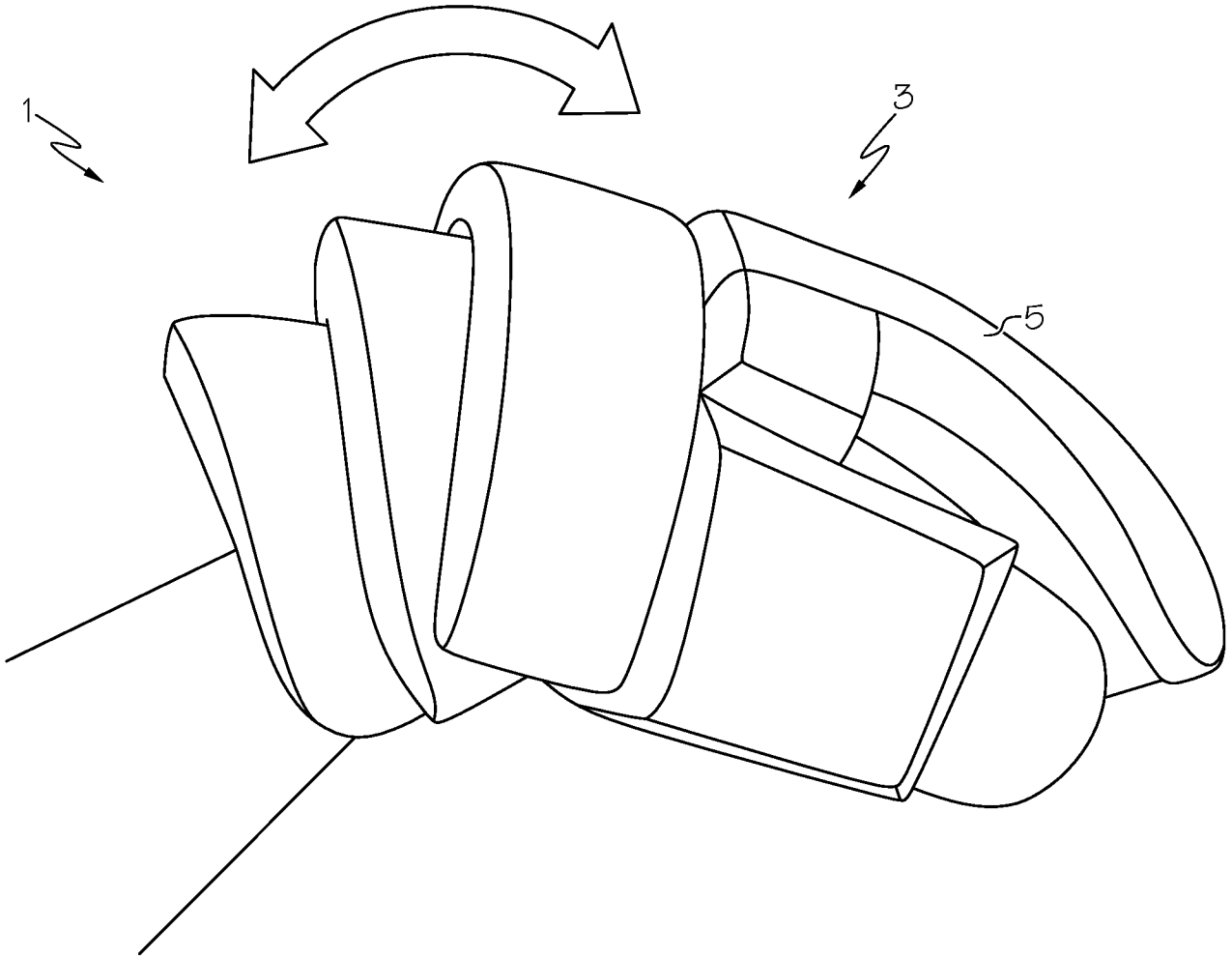
FIG. 1C depicts the hockey glove of FIG. 1A with the coil protection assembly, flexed in a second direction.

As shown in FIGS. 1A-1C, an exemplary coil protection assembly of the present disclosure may be coupled with or incorporated into a piece of sports equipment to protect a body part of the sports participant. In FIGS. 1-8, an exemplary coil protection assembly is illustrated and embodied in a wrist protection portion of a hockey glove. However, the coil protection assembly may be embodied in any protective feature of any type of sports equipment such as shin guards, shoulder pads, arm pads, or ankle pads.

In general, as shown in FIG. 1A, the coil protection assembly may be coupled with a piece of sports equipment such as a glove and specifically with respect to a hockey glove, overlaid with a wrist roll. In some versions of coil protection assembly, coil protection assembly is formed from an inner portion disposed inside an outer portion. The inner portion of coil protection assembly includes a core element preferably oriented in a coil or spiral shape having a plurality of spaces disposed and defined between adjacent spiral flights of the core element. The core element may be formed from a plastic, fiber, metal, or any other material and includes a first side and a second side. The inner portion may further include a foam liner disposed on the first side of the core element.

The outer portion may include a sleeve secured to a stretch material. The sleeve may be formed from a first strip and a second strip coupled together to define a channel therebetween. The first strip may be formed of a leather or synthetic leather or similar material. The second strip may be formed of a Lycra® or similar material. The sleeve is preferably oriented in a coil or spiral shape having a plurality of spaces defined between each spiral or flight. The stretch material is secured to adjacent flights of the spiral to extend between flights of sleeve. The stretch material is secured between flights of the sleeve to allow for flexing of the sleeve as a user bends or moves the user's wrist within the glove.

In some versions, the inner portion is fed into and disposed in a channel of the sleeve to form the coil protection assembly. The spiral orientation of the inner portion is complementary to the spiral orientation of the outer portion to facilitate the inner portion fitting snuggly within the outer portion. The stretch material allows the coil protection assembly to expand and flex when a user's wrist or other body part moves within the glove or any other sports related piece of equipment incorporating the coil protection assembly.

In some versions of coil protection assembly, the leading edge of the stretch material may be stitched or otherwise secured to the glove to connect the coil protection assembly to the glove. Similarly, ends of the outer portion may be secured to the glove by a stitch or other connection elements. In those versions of the underlying sport equipment element that includes a wrist roll, the wrist roll is secured to the glove by way of a breathable mesh or webbing and over the leading portion of the coil protection assembly to allow for flexibility of the user's hand, while still providing protection for the user's wrist.

The wrist roll may include a leading edge spaced apart from a trailing edge and a first end spaced apart from a second end. In some versions, wrist roll is secured to the glove proximate the leading edge to orient the trailing edge in an overlapping relationship with a portion of the coil protection assembly. The wrist roll may be secured with a webbing material to allow flexing of the wrist roll with respect to the glove. The area proximate the leading edge of the wrist roll may be secured to the glove with a first segment. Similarly, the first end of the wrist roll may be secured to the glove with a second segment and the second end of the wrist roll may be secured to the glove with a third segment. In this configuration, the overlapping trailing edge of the wrist roll is free from attachment to the glove and thus free to move as the user bends and flexes a wrist disposed within the glove.

In some versions of coil protection assembly, a lining may be stitched or otherwise secured to the coil protection assembly and/or the glove to provide a liner and a smooth inner surface for abutting the user's wrist and to aid in sliding the user's hand in and out of the glove. The lining may be a flexible and/or breathable material for wicking sweat or moisture from the user's wrist. The lining may extend from a top end to a spaced apart bottom end. In some versions of the coil protection assembly and/or the glove, a hook or loop material such as Velcro® is stitched to the top end of the lining and a corresponding or loop material is stitched to the interior of the glove to form a connection between the coil protection assembly and the lining proximate the top end. The bottom end of the lining may be stitched to the corresponding bottom area of the coil protection assembly to secure the lining within the coil protection assembly and the glove.

With specific reference to FIGS. 1A-8, a coil protection assembly (1) is depicted as incorporated into a piece of sports equipment (3). In this particular example, the piece of sports equipment (3) may be a glove, such as a glove (5) depicted in FIGS. 1A, 1B, 1C, and 8. While coil protection assembly (1) is shown and described herein as incorporated into glove (5), coil protection assembly (1) may be incorporated into any piece of sport equipment (3). For example, the piece of sports equipment may be embodied in a soccer shin guard, football shoulder padding, baseball catcher's gear, or any other piece of sports equipment.

FIGS. 1A-1C depicts glove (5) disposed on a user's hand with the user's wrist in various positions. In FIG. 1A, the user's wrist is in a "wrist neutral" position. In this position, coil protection assembly (1) is in a generally default, uncompressed, and unexpanded state. As will be described in greater detail below, coil protection assembly (1) is biased to this default position by way of flexible elastic fabric joining the coils together. In FIG. 1B, the user's wrist is in a "wrist extension" position, which orients glove (5) to flex in a first direction. In this position, coil protection assembly (1) is compressed as the coils are brought together due to the user's wrist moving towards the user's forearm. In FIG. 1C, the user's wrist is in a "wrist flexion" position, which orients glove (5) to flex in a second direction. In this position, coil protection assembly (1) is uncompressed and expanded as the coils are pulled away from one another due to the user's wrist moving away from the user's forearm. In each position depicted in FIGS. 1A-1C, coil protection assembly (1) provides protection to the user's wrist, while allowing for sufficient movement and flexibility within glove (5). This allows the user to perform the fine motor wrist movements required at higher levels of sporting competitions.

A. Coil Element

Figure 2A:
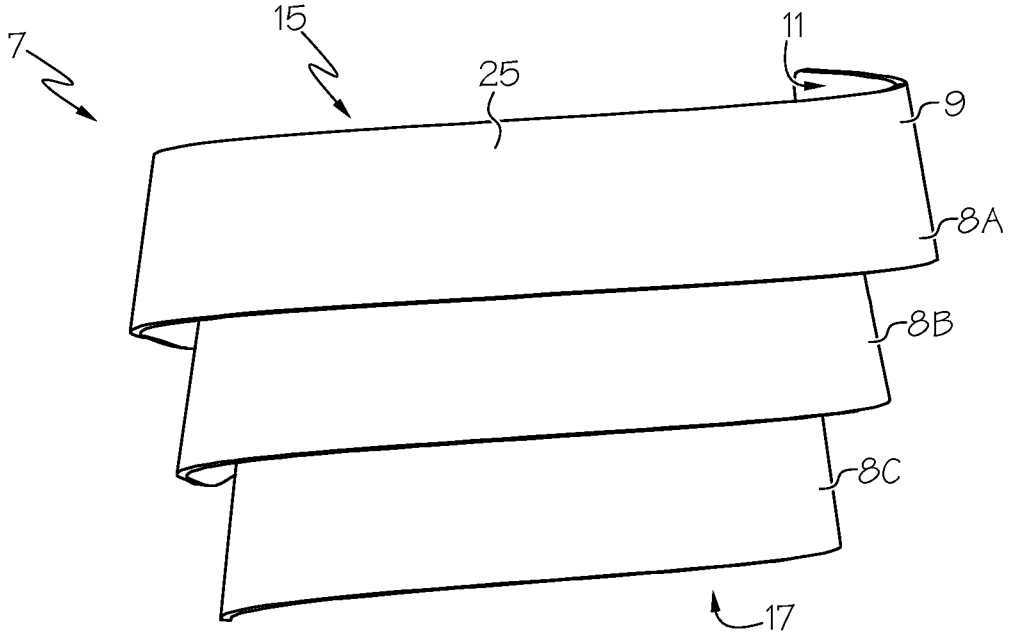
FIG. 2A depicts a top plan view of an exemplary coil element of the coil protection assembly of FIG. 1A having a plurality of loops.
Figure 2B:
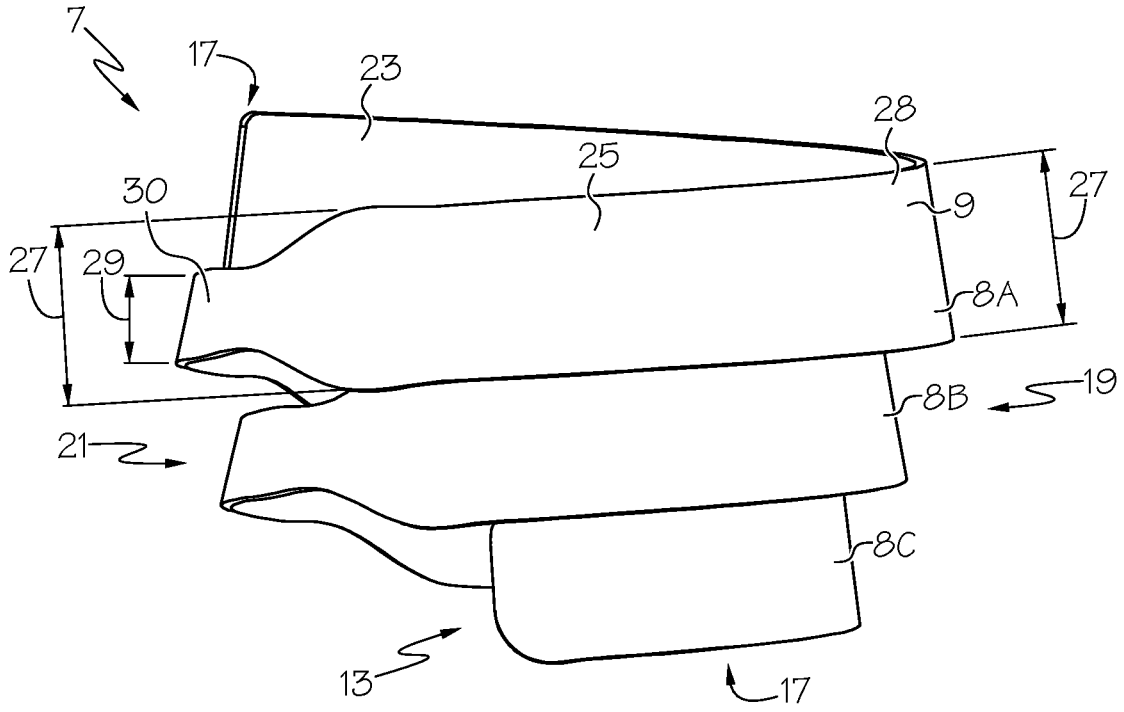
FIG. 2B depicts a left side elevational view of the coil element of FIG. 2A.
Figure 2C:
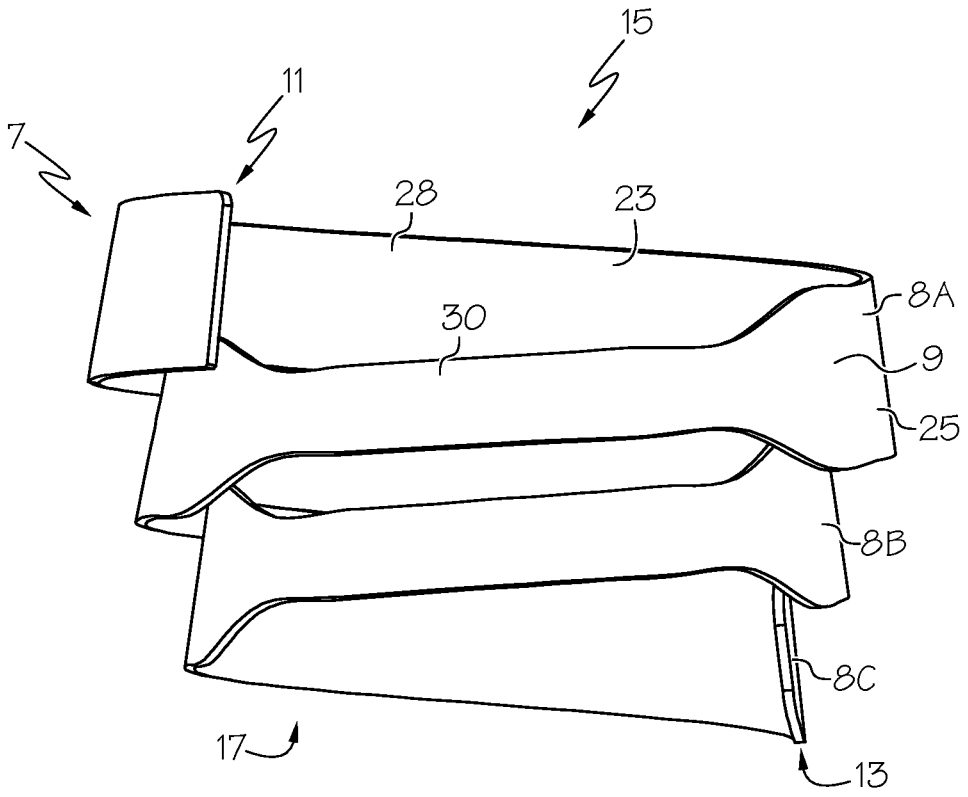
FIG. 2C depicts a bottom plan view of the coil element of FIG. 2A.

As shown in FIGS. 2A, 2B, and 2C, coil protection assembly (1) includes a coil element (7). Coil element (7) may be formed from an elongated strip of material (9) extending from a first end (11) to a second end (13) and coiled or biased into a plurality, of loops (8A, 8B, 8C) nested and/or overlapping one another. Coil element (7) includes a top end (15), a bottom end (17), a front side (19), and a rear side (21). Coil element (7) includes an interior surface (23) and an exterior surface (25).

Elongated strip of material (9) may have a variable thickness along the length from first end (11) to second end (13). For example, elongated strip of material (9) may have a first thickness proximate first end (11) and a second thickness proximate second end (13). In other versions, elongated strip of material (9) may have a first thickness disposed proximate front side (19) of coil element (7) and a second thickness disposed proximate rear side (21) of coil element (7).

Similarly, elongated strip of material (9) may have a variable width along the length from first end (11) to second end (13). For example, the width of elongated strip of material (9) may increase or decrease along the length between first end (11) to second end (13). In other versions, elongated strip of material (9) may have a first width (27) at a first portion (28) of elongated strip of material (9) and a second width (29) at a second portion (30) of elongated strip of material (9). In some versions of coil element (7), first portion (28) may be disposed proximate front side (19) of coil element (7) and a second portion (30) may be disposed proximate rear side (21) of coil element (7).

As shown in FIG. 2B, elongated strip of material (9) includes first width (27) in most areas along the length of elongated strip of material (9), yet the width is reduced to second width (29) in loop (8A) and loop (8B) proximate rear side (21) of coil element (7). With respect to FIGS. 1B and 1C, inasmuch as a user's wrist has less freedom to flex and bend in the first direction (FIG. 1B) rather than the second direction (FIG. 1C), coil element (7) may be disposed and oriented within coil protection assembly (1) whereby one or more portions of elongated strip of material (9) having a reduction in width are disposed to allow the user better flexibility toward that side of glove (5). For example, in some versions of coil protection assembly (1), rear side (21) may include second portion (30) having second width (29)

and be disposed proximate the user's palm area to allow the user better flexibility in the second direction (FIG. 1C) vis a vis the first direction (FIG. 1B).

B. Foam Layer

Figure 3:
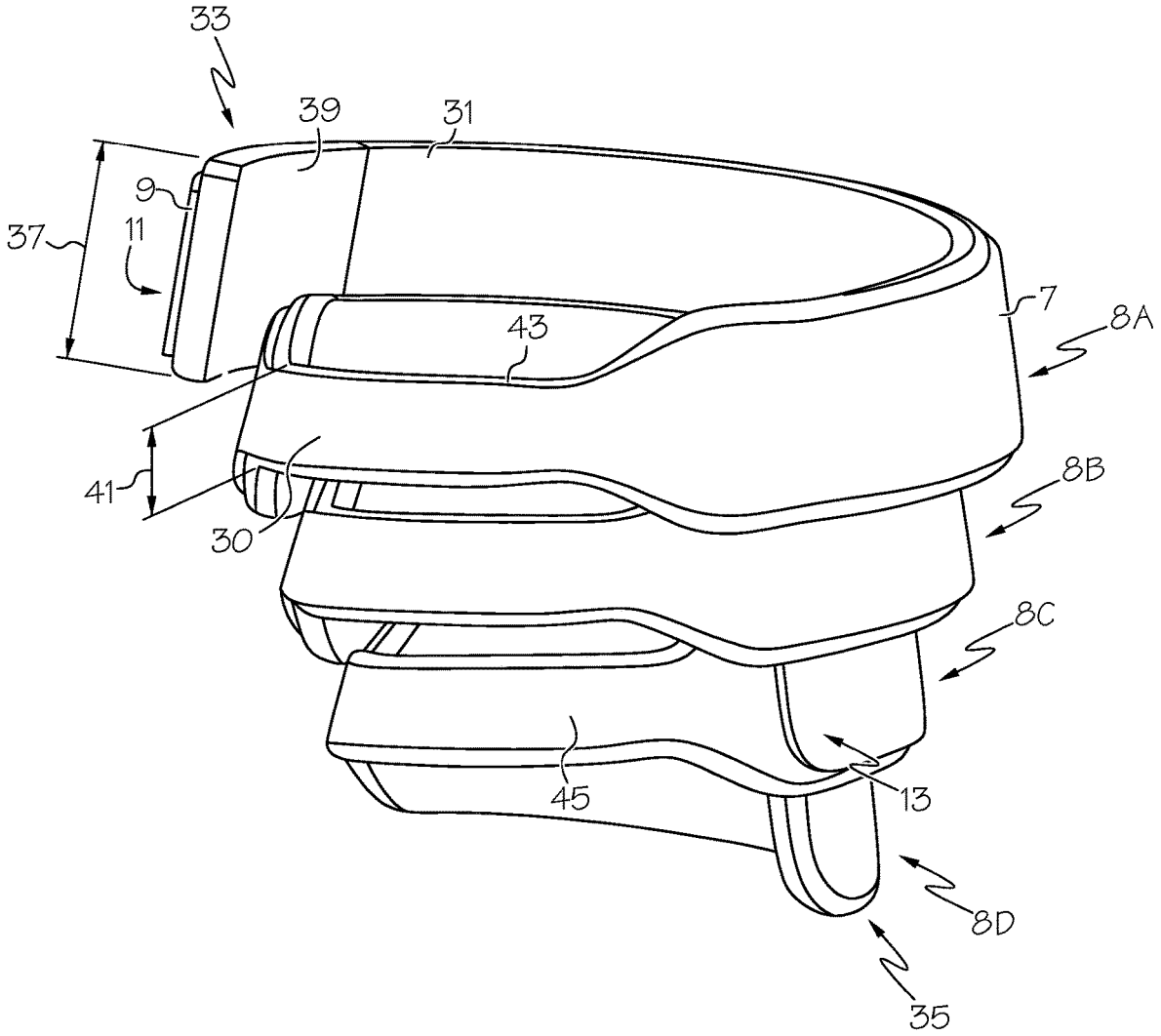
FIG. 3 depicts a perspective view of the coil element of FIG. 2A with padding applied to the interior thereof.

As shown in FIG. 3, a foam layer (31) may be connected with coil element (7). In some versions of coil protection assembly (1), foam layer (31) is disposed on interior surface (23) of coil element (7). In other versions, foam layer (31) is disposed on exterior surface (25) of coil element (7). In some versions, foam layer (31) is a dense foam with a thickness of between 0.2 and 0.3 inches. Foam layer (31) may be formed to have a width of slightly greater than the corresponding width of the area of elongated strip material (9) foam layer (31) is disposed on. Inasmuch as elongated strip of material (9) may have varying width along the length from first end (11) to second end (13), foam layer (31) may also have varying width. As shown in FIG. 3, the width of foam layer (31) is reduced proximate second portion (30) of elongated strip of material (9) when compared to first portion (28).

For example, the width of foam layer (31) may increase or decrease along the length between a first end (33) of foam layer (31) to a second end (35) of foam layer (31). In other versions, foam layer (31) may have a first width (37) at a first portion (39) of foam layer (31) and a second width (41) at a second portion (43) of foam layer (31). In some versions of coil protection assembly (1), first portion (39) may be disposed proximate front side (19) of coil element (7) and a second portion (43) may be disposed proximate rear side (21) of coil element (7). As shown in FIG. 3, first portion (28) and second portion (30) of elongated strip of material (9) is generally aligned and abutting with first portion (39) and second portion (13) of foam layer (31), respectively, whereby the widths of elongated strip of material (9) and foam layer (31) increase and decrease together.

An extension (45) to coil element (7) may be disposed at second end (13) of elongated strip of material (9). FIG. 3 depicts extension (45) as secured to second end (13) of elongated strip of material (9), though in other versions of coil protection assembly (1), extension (1) may be adhered with foam layer (31) or may incorporate any other mechanism for a secure attachment to second end (13) of elongated strip of material (9). Extension (45) may be formed from a flexible material such as neoprene and create an additional loop (8D) of the overall coil protection assembly (1). Foam layer (31) may, also extend onto extension (45) to provide additional backing and stability as well as maintain a smoother interior and transition from elongated strip of material (9) to extension (45). While extension (45) is shown and described as extending from second end (13) of elongated strip of material (9), in other versions of coil protection assembly (1), extension (45) may extend from first end (11) of elongated strip of material (9).

Figure 4:
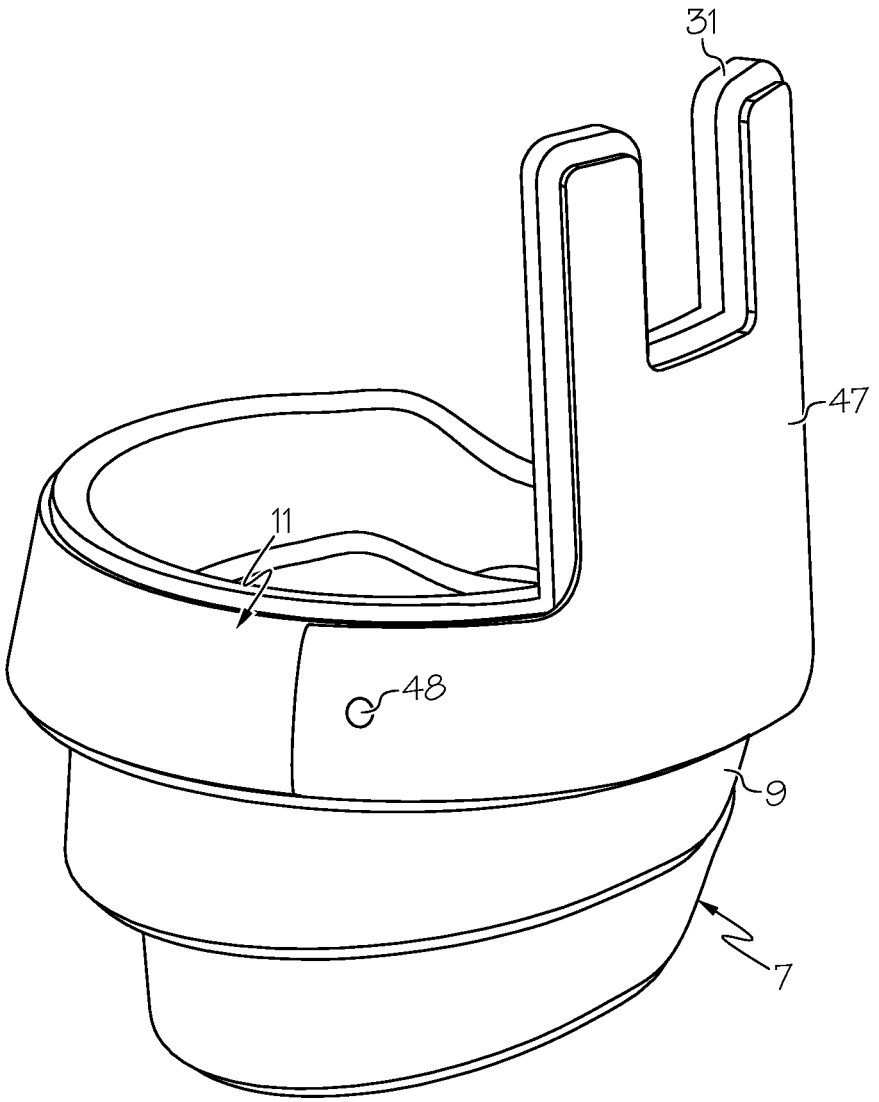
FIG. 4 depicts a perspective view of the coil element of FIG. 3 with a thumb protection element bolted to the coil element and padding applied thereto.

As shown in FIG. 4, a thumb guard (47) may be secured to first end (11) of elongated strip of material (9), For example, thumb guard (47) may be secured to elongated strip of material (9) by way of a rivet (48). Foam layer (31) may also be applied to the interior or exterior surface of thumb guard (47) to provide additional backing and stability as well as maintain a smooth surface.

C. Outer Layer

Figure 5:
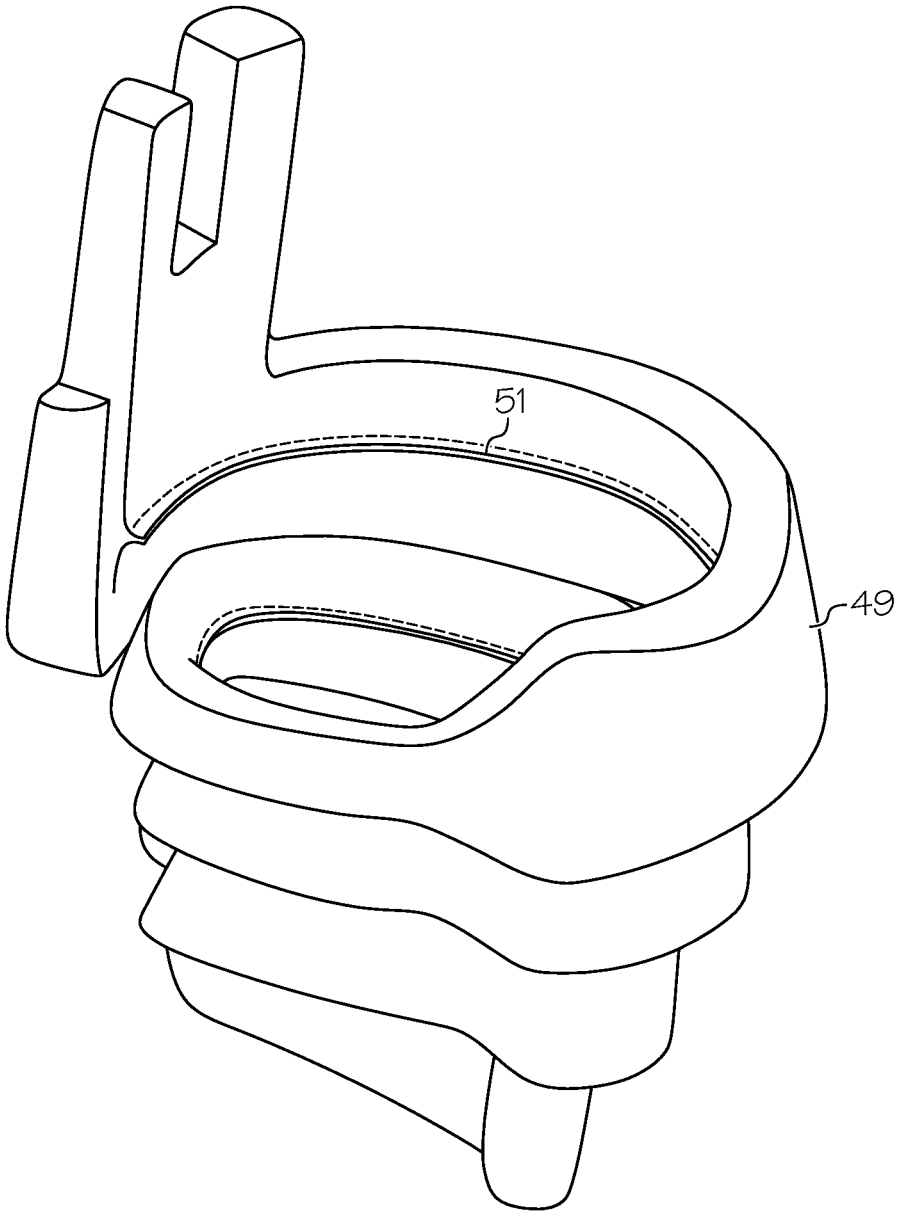
FIG. 5 depicts a perspective view of the coil protection assembly of FIG. 1A.

As shown in FIG. 5, coil element (7) coupled with foam layer (31) is encased in an outer layer (49). Outer layer (49) follows the structure of loops (8A, 8B, 8C, 8D), encasing each loop (8A, 8B, 8C, 8D) individually, rather than in one all-encompassing pocket or structure. Thus, loops (8A, 8B, 8C, 8D) maintain their freedom of movement with respect to one another and can flex apart or compress together depending on outside forces. In those versions of coil protection assembly (1) which include thumb guard (47), outer layer (49) encases thumb guard (47) as well.

Outer layer (49) encases coil element (7) and foam layer (31) to contain these two elements together on the interior of outer layer (49). Outer layer (49) may be comprised of a material such as leather or a synthetic leather-type of material. Outer layer (49) is wrapped around coil element (7) and foam layer (31) and connected or secured via a seam (51). Seam (51) follows the general direction of coil element (7) and foam layer (31) in a looping spiral to enclose coil element (7) and foam layer (31) in outer layer (49) entirely along the length of these two elements.

in some versions of coil protection assembly (1), seam (51) is applied at approximately the midpoint of coil element (7) and foam layer (31), as depicted in FIG. 5. In other versions, seam (51) is applied at the top-most or bottom-most edge of coil element (7) and foam layer (31).

D. Liner Material

Figure 6:
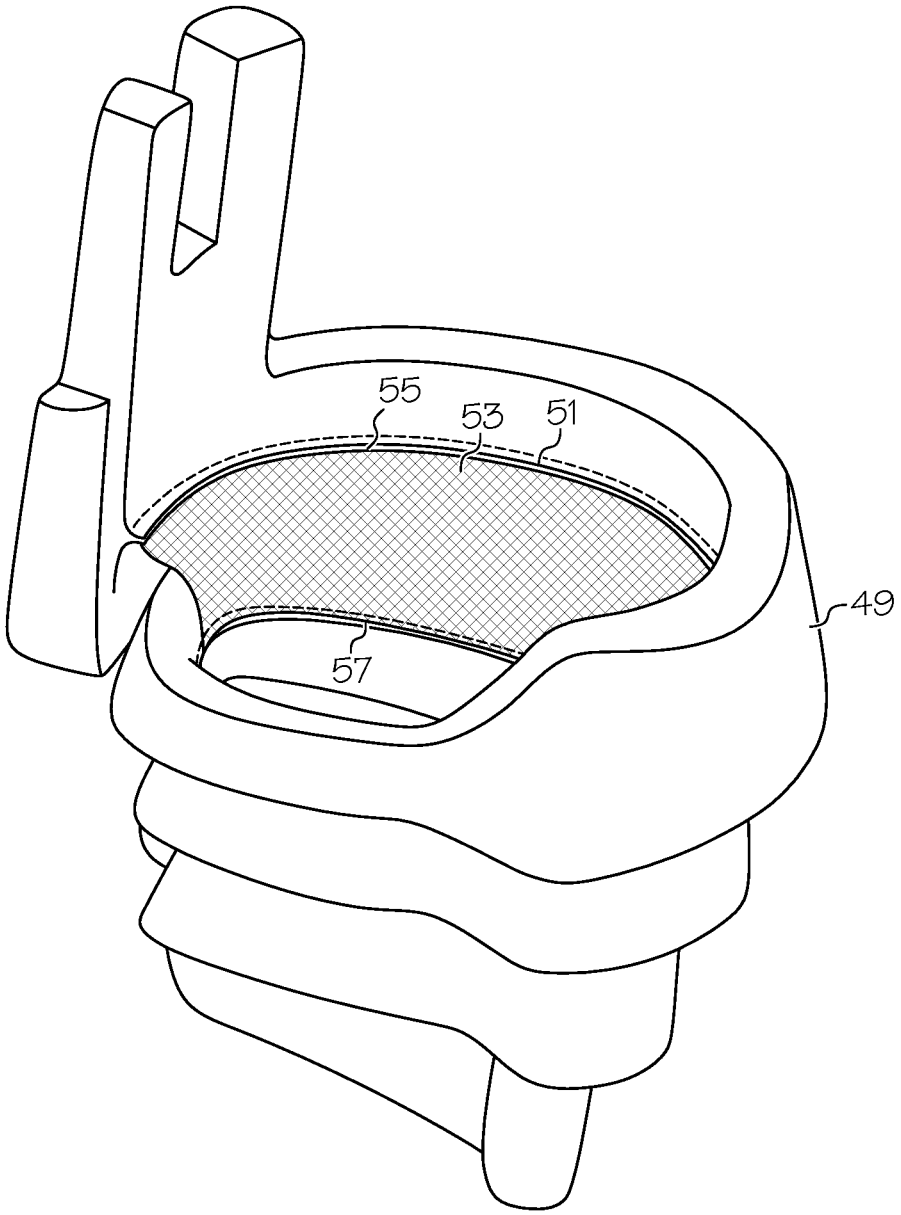
FIG. 6 depicts a perspective view of the coil protection assembly of FIG. 5 with an exemplary elastic fabric disposed thereon.

As shown in FIG. 6, a liner material (53) is applied to outer layer (49). In some versions of coil protection assembly (1), liner material (53) is an elastic or stretchy material that expands and retracts in response to pulling and releasing the material, respectively. In some versions of coil protection assembly (1), liner material (53) is a synthetic fiber such as Spandex, Lycra, or elastane with elasticity to expand and contract.

Liner material (53) may be applied in between each loop (8A, 8B, 8C, 8D) of coil element (7) to allow loops (8A, 8B, 8C, 8D) to expand away from or move with respect to each other to a certain distance (FIGS. 1B and 1C), while still being biased to the default position (FIG. 1A). Liner material (53) may also be in the shape of a sleeve or cylinder shape that is disposed within loops (8A, 8B, 8C, 8D).

Figure 7:
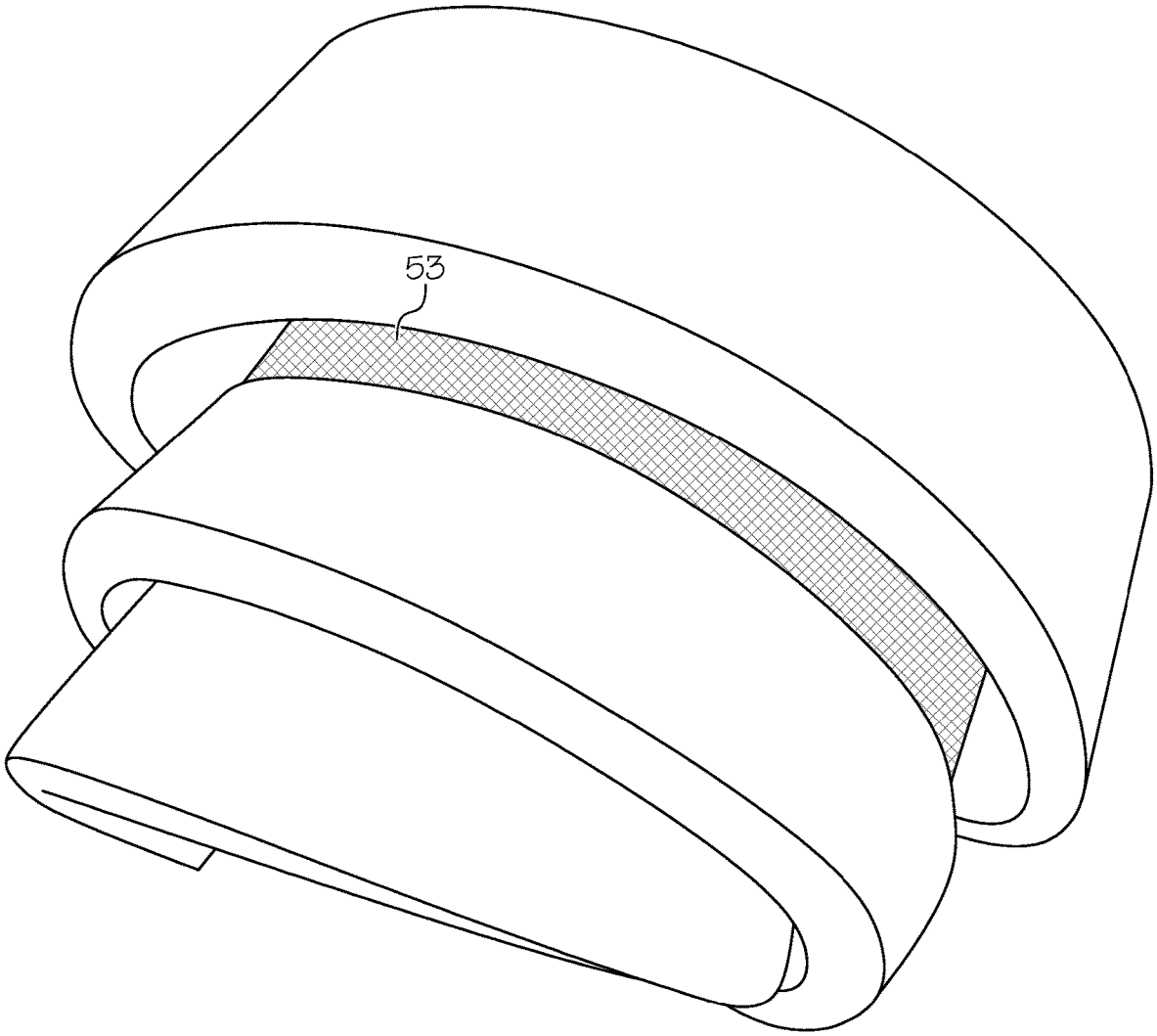
FIG. 7 depicts a perspective view of the exterior of the coil protection assembly of FIG. 6 with the elastic fabric exposed between two loops of the coil protection assembly.

In some versions of coil protection assembly (1), liner material (53) is an elongated strip secured to seam (51) as seam (51) spirals along with outer layer (49) on top of loops (8A, 8B, 8C, 8D). Thus, each loop (8A, 8B, 8C, 8D) is connected to the adjacent loop(s) (8A, 8B, 8C, 8D) via liner material (53). As shown in FIG. 7, in those versions of coil protection assembly (1) where liner material (53) is an elastic material, each loop (8A, 8B, 8C, 8D) may stretch and contract with respect to the adjacent loop(s).

In some versions of liner material (53), liner material (53) includes a first side (55) and a spaced apart second side (57). First side (55) and second side (57) may both be secured to seam (51) to apply liner material (53) between each loop (8A, 8B, 8C, 8D). In this orientation, liner material (53) is secured at a convenient portion of outer layer (49) in that seam (51) provides an attachment point for liner material (53) without stitching directly into the inner area encased by outer layer (49), such as foam layer (31) situated thereunder.

E. Incorporation into Sports Equipment

Figure 8:
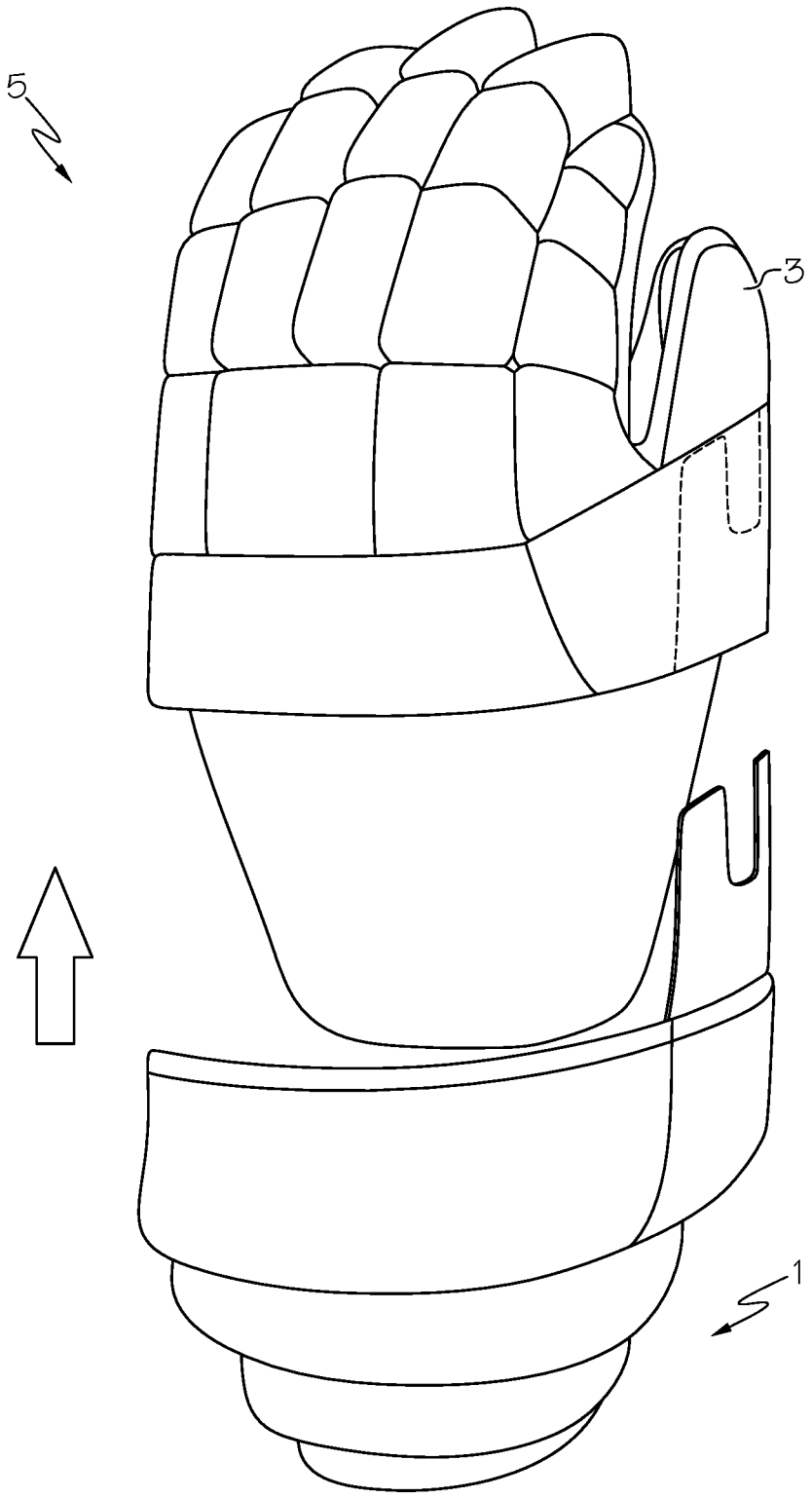
FIG. 8 depicts a perspective view of the coil protection assembly of FIG. 5 disconnected from the remainder of the hockey glove.

As shown in FIG. 8, once formed using the above described features, coil protection assembly (1) may be joined with piece of sports equipment (3). Depending on the particular piece of sports equipment (3), different joinder methods may be used. For example, as shown in FIG. 8, coil protection assembly (1) may be brought into proximity with piece of sports equipment (3) and stitched or glued thereon to form glove (5) If piece of sports equipment (3) is embodied in a soccer shin guard, coil protection assembly (1) may be placed into a pocket of a sock or other sleeve-like element. If piece of sports equipment (3) is embodied in a football shoulder pad, coil protection assembly (1) may be strapped or connected via clasp or snap to the remainder of the shoulder pad.

II. METHOD OF FORMING COIL PROTECTION ASSEMBLY

Figure 9:
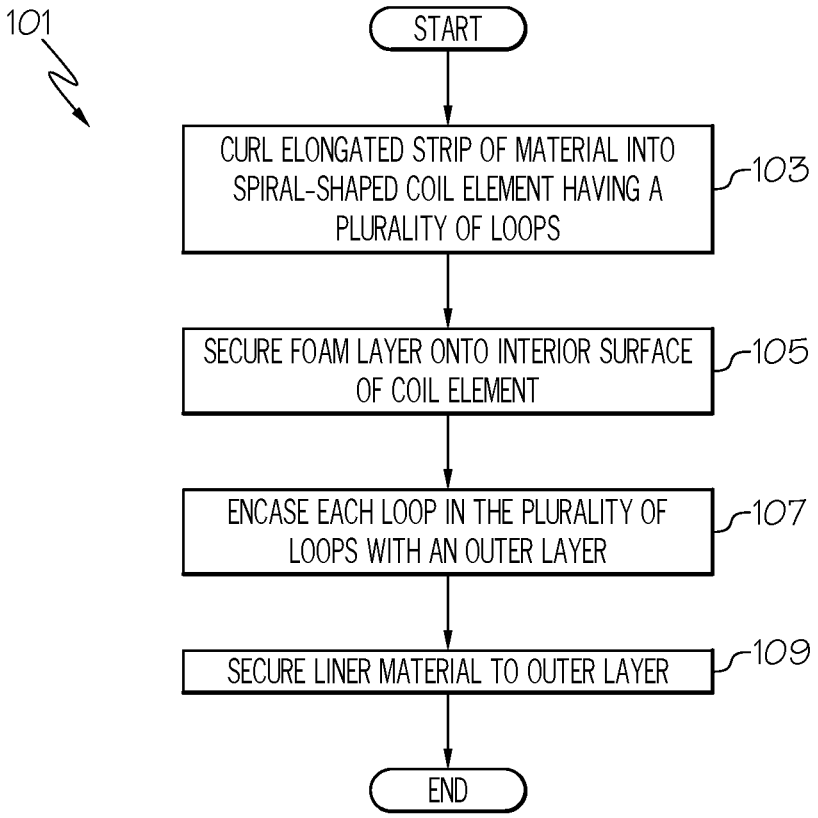
FIG. 9 depicts a flowchart for an exemplary method of forming a coil protection assembly similar to the coil protection assembly of FIG. 1A.

FIG. 9 depicts a method (101) for forming a coil protection assembly such as coil protection assembly (1). Method (101) begins with a step (103), whereby an elongated strip of material, such as elongated strip of material (9) as described above, is curled, bent, molded, or otherwise formed into a spiral-shaped coil element having a plurality of loops. The coil element of step (103) may be similar to coil element (7) and the plurality of loops of step (103) may be similar to loops (8A, 8B, 8C, 8D), both described above. Once the elongated strip of material is formed into the coil element, step (103) proceeds to a step (105). In step (105), a foam layer, such as foam layer (31) as described above, is adhered, secured, or otherwise applied onto an interior surface of the coil element. Foam layer may be any style of foam or padding and may include any stiffness necessary as needed for coil protection assembly. Once the foam layer is applied to the interior surface of the coil element, step (105) proceeds to a step (107).

In step (107), each loop of the coil element, along with the foam layer applied thereto, is encased or secured within an outer layer of material. This outer layer of material may be similar to outer layer (49) as described above and may be in the form of leather, synthetic leather, or any other type of material. Each loop of the coil element is individually wrapped to allow for movement of the loops with respect to one another. In other words, the entirety of the coil element and the foam layer is not disposed in one monolithic pocket. Each loop and layer of form is enclosed or encased such that the profile of the coil element is maintained, and each loop is free to move in a spring-like fashion with respect to one another. The encasement of the coil element and the foam layer may require a seam or stitching to connect two portions of the outer layer of material. After each loop is encased within the outer layer, step (107) proceeds to a step (109).

In step (109), a liner material is applied to all or some portion of the interior of the encased coil element. The liner material may be similar to liner material (53) described above and may be an elastic or stretchy material. In some versions of step (109), the liner material is applied between two loops to allow these loops to stretch away from each other as needed by the sports participant, while thereafter retracting back to a normal default position in response to the elasticity of the liner material. In some versions of step (109), a portion of the liner material is secured to the seam created where two portions of the outer layer is brought together to be joined. In some versions of step (109) the liner material is in the form of a sleeve or cylindrically shaped cuff that is placed inside the interior of the encased coil element and secured therein. After the liner material is secured to the outer layer, method (101) ends.

III. EXEMPLARY COMBINATIONS

The following examples relate to various non-exhaustive ways in which the teachings herein may be combined or applied. It should be understood that the following examples are not intended to restrict the coverage of any claims that may be presented at any time in this application or in subsequent filings of this application. No disclaimer is intended. The following examples are being provided for nothing more than merely illustrative purposes. It is contemplated that the various teachings herein may be arranged and applied in numerous other ways. It is also contemplated that some variations may omit certain features referred to in the below examples. Therefore, none of the aspects or features referred to below should be deemed critical unless otherwise explicitly indicated as such at a later date by the inventors or by a successor in interest to the inventors. If any claims are presented in this application or in subsequent filings related to this application that include additional features beyond those referred to below, those additional features shall not be presumed to have been added for any reason relating to patentability.

Example 1

A coil protection assembly comprising an inner portion and an outer portion defining a first coil and a second coil.

Example 2

The coil protection assembly of Example 1 or any of the subsequent Examples, further comprising a channel defined by the outer portion.

Example 3

The coil protection assembly of any of the proceeding or subsequent Examples, wherein the inner portion is disposed in the channel.

Example 4

The coil protection assembly of any of the proceeding or subsequent Examples, further comprising a material secured to the first coil and the second coil.

Example 5

A device comprising a piece of sports equipment defining a hand opening and a coil protection assembly secured in the hand opening.

Example 6

The device of any of the proceeding or subsequent Examples, wherein the coil protection assembly comprises an inner portion and an outer portion defining a first coil and a second coil.

Example 7

The device of any of the proceeding or subsequent Examples, wherein the coil protection assembly comprises a channel defined by the outer portion.

Example 8

The device of any of the proceeding or subsequent Examples, wherein the inner portion is disposed in the channel.

Example 9

The device of any of the proceeding or subsequent Examples, wherein the coil protection assembly comprises a material secured to the first coil and the second coil.

Example 10

The device of any of the proceeding or subsequent Examples, further comprising a wrist roll secured to one or both of the piece of sports equipment and the coil protection assembly.

Example 11

The device of any of the proceeding or subsequent Examples, further comprising a lining secured to one or both of the piece of sports equipment and the coil protection assembly.

Example 12

A method of protecting a wrist comprising forming an inner portion of a coil protection assembly, forming an outer portion of the coil protection assembly, and coupling the inner portion and the outer portion to form the coil protection assembly, Example 13

The method of any of Example 12 or any of the subsequent Examples, further comprising disposing the inner portion inside the outer portion to form the coil protection assembly.

Example 14

The method of any of the proceeding or subsequent Examples, further comprising securing the coil protection assembly to a piece of sports equipment.

Example 15

The method of any of the proceeding or subsequent Examples, further comprising securing a wrist roll to one or both of the coil protection assembly and the piece of sports equipment.

Example 16

The method of any of the proceeding or subsequent Examples, further comprising securing a leading edge of the wrist roll to secure the wrist roll to one or both of the coil protection assembly and the piece of sports equipment, wherein a trailing edge of the wrist roll is free.

Example 17

The method of any of the proceeding or subsequent Examples, further comprising securing a lining to one or both of the coil protection assembly and the piece of sports equipment.

Example 18

A coil protection assembly configured to be incorporated into a piece of sports equipment, the coil protection assembly comprising (a) a coil element comprising: (i) an exterior surface; and (ii) an interior surface; (b) a foam layer disposed on the interior surface of the coil element; (c) an outer layer enclosing the coil element and the foam layer; and (d) a strip of liner material secured to the outer layer.

Example 19

The coil protection assembly of any of the previous or subsequent Examples, the coil element further comprising an elongated strip of material coiled into a plurality of loops.

Example 20

The coil protection assembly of any of the previous or subsequent Examples, wherein the elongated strip of material comprises a first thickness at a first portion of the elongated strip of material and a second thickness at a second portion of the elongated strip of material.

Example 21

The coil protection assembly of any of the previous or subsequent Examples, wherein the elongated strip of material comprises a first width at a first portion of the elongated strip of material and a second width at a second portion of the elongated strip of material.

Example 22

The coil protection assembly of any of the previous or subsequent Examples, wherein the elongated strip of material comprises the first width at a third portion of the elongated strip of material and the second width at a fourth portion of the elongated strip of material, wherein the coil element further comprises a first side and a second side, wherein the first side is opposite the second side, wherein the first portion and the third portion are disposed on the first side, wherein the second portion and the fourth portion are disposed at the second side.

Example 23

The coil protection assembly of any of the previous or subsequent Examples, wherein the plurality of loops are overlapping and nested together.

Example 24

The coil protection assembly of any of the previous or subsequent Examples, further comprising a thumb guard secured to the coil assembly.

Example 25

The coil protection assembly of any of the previous or subsequent Examples, wherein the elongated strip of material comprises a first material extending from a first end to a second end, the coil element further comprising a segment comprising a second material and extending from the first end of the elongated strip of material.

Example 26

The coil protection assembly of any of the previous or subsequent Examples, wherein the first material is a rigid plastic, wherein the second material is neoprene.

Example 27

The coil protection assembly of any of the previous or subsequent Examples, wherein the segment comprises an exterior surface and an interior surface, wherein the foam layer extends from the coil element onto the interior surface of the segment.

Example 28

The coil protection assembly of any of the previous or subsequent Examples, wherein the elongated strip of material comprises a strip width, wherein the foam layer comprises a foam width, wherein the foam width is greater than the strip width along the entire length of the elongated strip of material.

Example 29

The coil protection assembly of any of the previous or subsequent Examples, further comprising a seam, wherein the seam secures the outer layer around the coil element and the foam layer.

Example 30

The coil protection assembly of any of the previous or subsequent Examples, wherein the strip of liner material is a strip of elastic material, wherein a portion of the strip of elastic material is secured to a portion of the seam.

Example 31

The coil protection assembly of any of the previous or subsequent Examples, wherein the strip of liner material is a strip of elastic material, wherein the strip of elastic material extends from a first portion of the seam to a second portion of the seam.

Example 32

The coil protection assembly of any of the previous or subsequent Examples, wherein the strip of liner material is a strip of elastic material, wherein the strip of elastic material is secured to a first portion of the seam, wherein the strip of elastic material is secured to a second portion of the seam, wherein the strip of elastic material is not secured to a third portion of the seam, wherein the third portion of the seam is disposed in between the first portion of the seam and the second portion of the seam.

Example 33

A coil protection assembly configured to be incorporated into a piece of sports equipment, the coil protection assembly comprising: (a) an elongated strip of material extending from a first end to a second end and biased to form a plurality of loops nested with one another; (b) a foam layer secured to the elongated strip of material from the first end to the second end; and (c) an outer layer enclosing the elongated strip of material and the foam layer.

Example 34

The coil protection assembly of any of the previous or subsequent Examples, further comprising a strip of elastic material secured to the outer layer.

Example 35

The coil protection assembly of any of the previous or subsequent Examples, wherein a first edge of the strip of elastic material is secured to a first loop in the plurality of loops, wherein a second edge of the strip of elastic material is secured to a second loop in the plurality of loops.

Example 36

A method of forming a coil protection assembly comprising: (a) curling an elongated strip of material into a spiral-shaped coil element having a plurality of loops; (b) securing a foam layer onto an interior surface of the coil element; (c) encasing each loop in the plurality of loops with an outer layer; and (d) securing a liner material to the outer layer, wherein the liner material is elastic.

Example 37

The method of any of the previous or subsequent Examples; further comprising: (a) securing the outer layer around each loop in the plurality of loops with a seam; and (b) securing the liner material to the seam.

IV. MISCELLANEOUS

It should be understood that any of the examples described herein may include various other features in addition to or in lieu of those described above. By way of example only, any of the examples described herein may also include one or more of the various features disclosed in any of the various references that are incorporated by reference herein.

It should be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements; or other disclosure material set forth herein will only be incorporated to the extent that no conflict arises between that incorporated material and the existing disclosure material.

Having shown and described various versions of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art.

For instance, the examples, versions, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

We claim:

1. A coil protection assembly configured to be incorporated into a piece of sports equipment, the coil protection assembly comprising:

(a) a coil element comprising:

i) an exterior surface, (ii) an interior surface, (iii) an elongated strip of material coiled into a plurality of loops, wherein the elongated strip of material comprises a first material extending from a first end to a second end, and (iv) a segment comprising a second material and extending from the first end of the elongated strip of material, wherein the segment comprises an exterior surface and an interior surface;

(b) a foam layer disposed on the interior surface of the coil element, wherein the foam layer extends from the coil element onto the interior surface of the segment (c) an outer layer enclosing the coil element and the foam layer; and (d) a strip of liner material secured to the outer layer.

2. The coil protection assembly of claim 1, wherein the elongated strip of material comprises a first thickness at a first portion of the elongated strip of material and a second thickness at a second portion of the elongated strip of material.

3. The coil protection assembly of claim 1, wherein the elongated strip of material comprises a first width at a first portion of the elongated strip of material and a second width at a second portion of the elongated strip of material.

4. The coil protection assembly of claim 1, wherein the plurality of loops are overlapping and nested together.

5. The coil protection assembly of claim 1, further comprising a thumb guard secured to the coil element.

6. The coil protection assembly of claim 1, wherein the first material is a rigid plastic, wherein the second material is neoprene.

7. The coil protection assembly of claim 1, further comprising a seam, wherein the seam secures the outer layer around the coil element and the foam layer.

8. The coil protection assembly of claim 7, wherein the strip of liner material is a strip of elastic material, wherein a portion of the strip of elastic material is secured to a portion of the seam.

9. A coil protection assembly configured to be incorporated into a piece of sports equipment, the coil protection assembly comprising:

(a) a coil element comprising:

(i) an exterior surface, (ii) an interior surface, and (iii) an elongated strip of material coiled into a plurality of loops, wherein the elongated strip of material comprises a strip width;

(b) a foam layer disposed on the interior surface of the coil element, wherein the foam layer comprises a foam width, wherein the foam width is greater than the strip width along the entire length of the elongated strip of material;

(c) an outer layer enclosing the coil element and the foam layer; and (d) a strip of liner material secured to the outer layer.

10. The coil protection assembly of claim 9, wherein the elongated strip of material comprises a first thickness at a first portion of the elongated strip of material and a second thickness at a second portion of the elongated strip of material.

11. The coil protection assembly of claim 9, wherein the elongated strip of material comprises a first width at a first portion of the elongated strip of material and a second width at a second portion of the elongated strip of material.

12. The coil protection assembly of claim 9, wherein the plurality of loops are overlapping and nested together.

13. The coil protection assembly of claim 9, further comprising a thumb guard secured to the coil element.

14. The coil protection assembly of claim 9, wherein the elongated strip of material comprises a first material extending from a first end to a second end, the coil element further comprising a segment comprising a second material and extending from the first end of the elongated strip of material.

15. The coil protection assembly of claim 14, wherein the first material is a rigid plastic, wherein the second material is neoprene.

16. The coil protection assembly of claim 9, further comprising a seam, wherein the seam secures the outer layer around the coil element and the foam layer.

17. A coil protection assembly configured to be incorporated into a piece of sports equipment, the coil protection assembly comprising:

(a) a coil element comprising:

(i) an exterior surface, and (ii) an interior surface;

(b) a foam layer disposed on the interior surface of the coil element;

(c) an outer layer enclosing the coil element and the foam layer;

(d) a strip of liner material secured to the outer layer;

(e) a seam, wherein the seam secures the outer layer around the coil element and the foam layer; and wherein the strip of liner material is a strip of elastic material, wherein the strip of elastic material is secured to a first portion of the seam, wherein the strip of elastic material is secured to a second portion of the seam, wherein the strip of elastic material is not secured to a third portion of the seam, wherein the third portion of the seam is disposed in between the first portion of the seam and the second portion of the seam.

18. The coil protection assembly of claim 17, the coil element further comprising an elongated strip of material coiled into a plurality of loops.

19. The coil protection assembly of claim 18, wherein the elongated strip of material comprises a first thickness at a first portion of the elongated strip of material and a second thickness at a second portion of the elongated strip of material.

20. The coil protection assembly of claim 19, wherein the elongated strip of material comprises a first width at a first portion of the elongated strip of material and a second width at a second portion of the elongated strip of material.

* * * * *